United States Patent [19]

Obermann et al.

[11] Patent Number: 4,912,939

[45] Date of Patent: Apr. 3, 1990

[54] MAKING ICE IN A REFRIGERATOR

[75] Inventors: George Obermann, Niles; David Troscinski, Woodridge, both of Ill.

[73] Assignee: Eaton Corporation, Cleveland, Ohio

[21] Appl. No.: 316,848

[22] Filed: Feb. 28, 1989

[51] Int. Cl.[4] ..... F25C 1/04

[52] U.S. Cl. ..... 62/233; 200/38 CA

[58] Field of Search ..... 62/233; 200/38 C, 38 CA, 200/283

[56] References Cited

U.S. PATENT DOCUMENTS

| | | | |
|---|---|---|---|
| 2,994,206 | 8/1961 | Shaw et al. | 62/233 X |
| 3,541,806 | 11/1970 | Jacobs | 62/233 |
| 3,752,944 | 8/1973 | Cartier et al. | 200/38 C X |
| 3,779,032 | 12/1973 | Nichols | 62/233 |
| 4,297,545 | 10/1981 | Darner | 200/283 X |
| 4,697,432 | 10/1987 | Cole | 62/233 |
| 4,734,548 | 3/1988 | Cole | 200/283 X |

*Primary Examiner*—William E. Tapolcai
*Attorney, Agent, or Firm*—R. A. Johnston

[57] ABSTRACT

An icemaker for a refrigerator having a motorized cam actuated switch for controlling the water fill valve and motor hold switch. The cam tracks for each switch has an undercut radial step. The switches each have a lower contact blade and upper contact blade with an intermediate blade of longer length. A spacer attached to the upper or lower contact blade maintains a predetermined minimum spacing therebetween. The lower contact blade drops first over the step allowing the upper blade to close against the intermediate blade energizing the water valve and opening the lower contact set. The intermediate blade then drops over the step, closing the lower contact blade set and the spacer holds the upper contact set open for deenergizing the water valve. A similar fast action switch is employed as a motor hold switch during periods when the ice sensing thermostat is open.

2 Claims, 4 Drawing Sheets

MAKING ICE IN A REFRIGERATOR

CROSS REFERENCE TO RELATED APPLICATION

This invention is related to the icemaker described and claimed in copending application Ser. No. 258,308 filed Oct. 17, 1988 in the name of Frank K. Karlovits and assigned to the assignee of the present invention.

BACKGROUND OF THE INVENTION

The present invention relates to apparatus for making particle ice in a refrigerator for domestic or household use and particularly icemakers of the type for continuously making ice used for cooling beverages. Icemakers of this type typically form ice by a timed water fill of a mold and upon freezing of the water in the mold harvest by mechanically removing the ice from the mold and permitting the particles to fall into a collector tray or bin.

The timing of the waterfill is typically controlled by a motor driven timing cam which activates a switch for controlling the opening and closing of an electrically operated water fill valve. Heretofore, it has been the practice to time the valve opening by providing a snap acting microswitch mounted on a bracket which is adjustably positioned on the icemaker housing with respect to the motor driven timing cam. The bracket is adjusted with respect to the cam for calibrating the time between actuation and deactuation of the microswitch for a given cam profile and rate of rotation. This manner of setting the timing for the opening and closing of the switch for the electric waterfill valve has proven to be costly and troublesome in high volume manufacturing. In particular, where the microswitch is calibrated for actuation upon an increase in cam profile, the deactuation must then occur on a decrease in cam profile; and, the time to fill the mold is determined by the rate of rotation of the cam and the shape of the cam with respect to the deadband or difference between actuation and deactuation of the microswitch. In a typical microswitch, the deadband of the switch snap acting blade mechanism is variable and typically is not repeatable within a degree of a accuracy required to properly control valve open time for controlled waterfill of the mold. Accordingly, it has proven extremely difficult to calibrate the microswitch against a given constantly rotating cam profile to provide precisely controlled timing of opening and closing of the waterfill valve in response to actuation and deactuation of a snap acting microswitch.

It has thus been desired to find a simple and low cost way or means of providing precisely timed opening of a flow-calibrated valve for measured fill of a mold for forming ice in a refrigerator icemaker.

SUMMARY OF THE INVENTION

The present invention provides a solution to the above-described problem of providing a simple and accurate way of calibrating and controlling timed flow of water fill in a mold for forming ice in a refrigerator. The present invention employs a predetermined cam profile rotating at a fixed rate for actuating and deactuating resilient switch contact blades for energizing and deenergizing an electrically operated valve for controlling flow to the ice forming mold. In the present invention the ends of switch contact blades follow the cam profile which has a radial step to provide rapid making and breaking of the contacts on the switch blade for precise timing of the opening and closing of the water valve for a given rate of rotation of the timing cam.

The switch mechanism includes an upper, lower and intermediate contact blade arranged for single pole, double throw actuation, with the intermediate blade extending beyond the ends of the upper and lower blades. The blades are self-biased toward the cam. The cam profile has an undercut radial step which enables the lower blade to drop rapidly while the intermediate blade is held. A slight rotation of the cam subsequently enables the intermediate blade to then drop over the radial step onto the lower blade.

A floating spacer is provided to maintain a predetermined minimum spacing between the upper and lower contact blades to thereby provide simultaneous quick opening of the lower contact set and quick closing of the upper contact set with follow-on quick opening of the closed upper contact set. The present invention thus provides a rapid opening and closing actuation of resilient spring contact blades by employing a floating spacer to maintain the spacing of the outer contact blades during transfer of the intermediate blade. The spacer is rigidly attached to one of the upper or lower contact blades thereby determining the position of the switch side contacts relative to each other and eliminating the need to calibrate the switch actuation and deactuation points with respect to the cam track.

DETAILED DESCRIPTION

Figure 1:
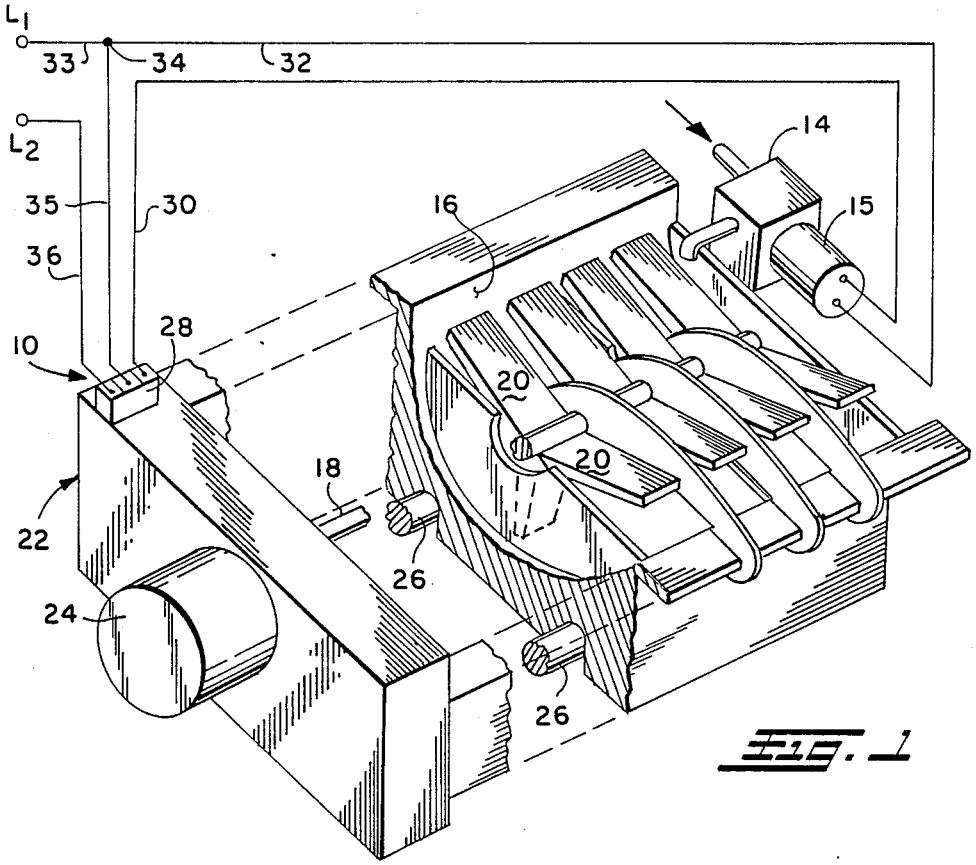
FIG. 1 is a pictorial, somewhat schematic, of the electrical connection of the control system of the present invention.
Figure 4:
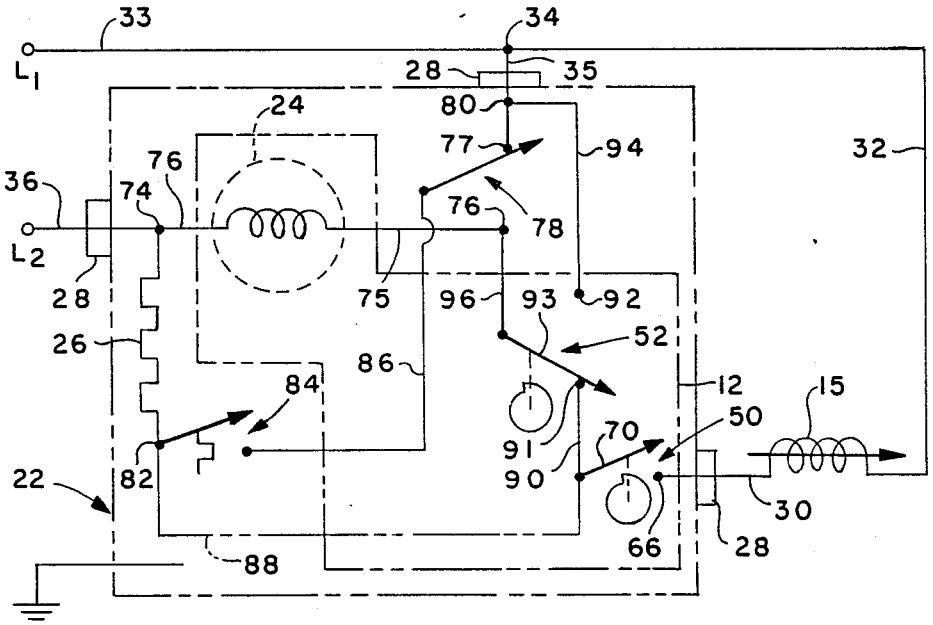
FIG. 4 is a schematic of the icemaker electrical circuitry.

Referring to FIG. 1 and FIG. 4, the control system is indicated generally at 10 as having a programmer indicated by the dashed outline and reference numeral 12 for controlling valve 14 electrically operated by a solenoid 15 indicated generally at 22 for filling a mold 16. An ice harvesting means is provided comprising shaft 18 with spaced paddles 20 is driven by a controller and gear box indicated generally at 22 powered by motor 24 which effects rotation of shaft 18 to harvest ice formed in the mold 16. A resistance heater 26 is provided to effect surface melting of the ice in the mold to permit the ice to be swept from the mold by the paddles 20 in a manner well known in the art.

The controller 22 has a three pin terminal connector 28 provided thereon and has a wiring harness which has one pin thereof connected via lead 30 to one terminal of the water valve solenoid 15, with the remaining terminal of the coil 15 connected via lead 32 through junction 34 and lead 33 to one side $L_1$ of the power line. Junction 34 is also connected to the center pin of connector 28 via lead 35; and, the remaining pin of connector 28 is connected via lead 36 to the remaining side $L_2$ of the power line. The details of the internal switching devices and circuitry of the controller 22 will be described hereinafter.

Figure 2:
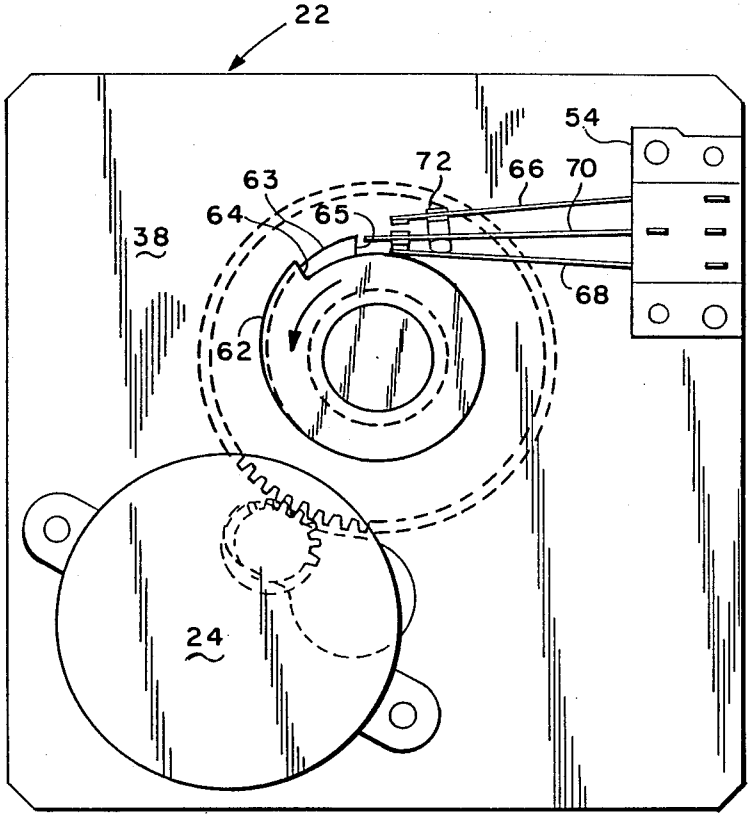
FIG. 2 is an interior plan view of the motorized programmer employed with the icemaker system of FIG. 1.
Figure 3:
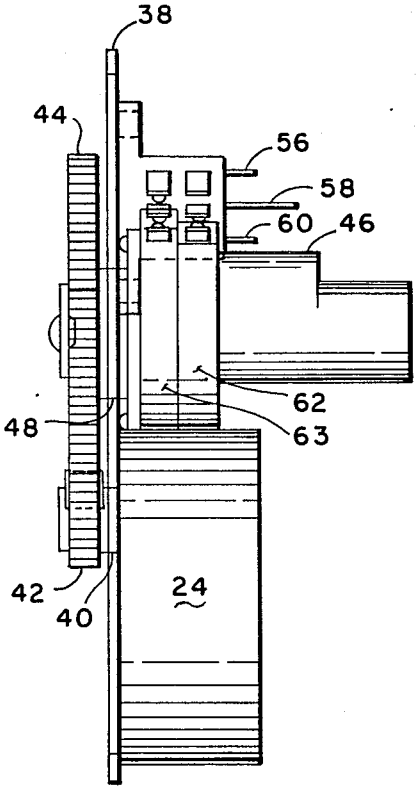
FIG. 3 is a side view of the controller of FIG. 2.

Referring to FIGS. 2 and 3, the controller 22 is illustrated with the housing or cover removed from the deck plate 38 thereof which has a drive motor 24 mounted on one side thereof, with the motor shaft 40 extending through the deck plate and having a motor pinion 42 provided thereon. The pinion 42 drives a driven gear 44 which in turn drives a cam drum 46 via a shaft 48 which extends through the deck plate such that the cam drum 46 is disposed on the same side of the deck plate as motor 24.

A pair of switch assemblies, indicated generally at 50, 52 are mounted on a switch block 54 which is attached to the deck plate and has electrical connector terminals 56, 58, 60 extending therefrom adapted for wiring connection thereto as will hereinafter be described.

Referring to FIGS. 2 and 3, cam drum 46 has a cam truck 62 provided thereon and which has a radial step 64 provided thereon which is preferably slightly undercut.

Although the step 64 on cam track 62 is in the radial direction in the illustrated embodiment, it will be understood that cam track 62 may also comprise a face cam, in which case step 64 would be in the axial direction.

Switch 50 comprises an upper resilient contact blade arm 66 extending from terminal block 54 and a lower resilient contact blade arm 68 extending in generally spaced parallel arrangement with upper arm 66. An intermediate resilient contact blade arm 70 is disposed between the arms 66 and 68, with the arms biased in a common direction for contacting and following the cam track 62. A spacer, indicated by the reference numeral 72, is attached to either one of the upper and lower blades 66, 68 and is movable therewith for maintaining a minimum spacing between the blades 66, 68.

Figure 9:
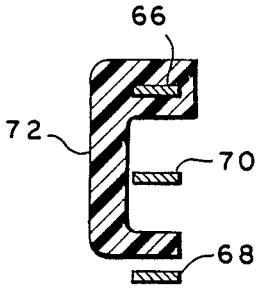

Referring to FIG. 9, the spacer 72 is preferably formed of a member having a generally C-shaped configuration' with the upper contact arm 66 received therethrough so that the spacer 72 moves with the contact blade 66. In the arrangement shown in FIG. 9, the lower leg of the C-shaped spacer 72 extends between the lower blade 68 and the intermediate blade 70 to maintain the lower blade 68 a predetermined minimum distance from the upper blade 66. Although the spacer has been illustrated in the arrangement of FIG. 9, as having the upper contact blade 66 received therethrough, it will be understood that alternatively, the spacer can be formed with the lower contact blade 68 received therethrough and with the upper leg of the C-shape disposed between contact blades 66 and 70.

Figure 5:
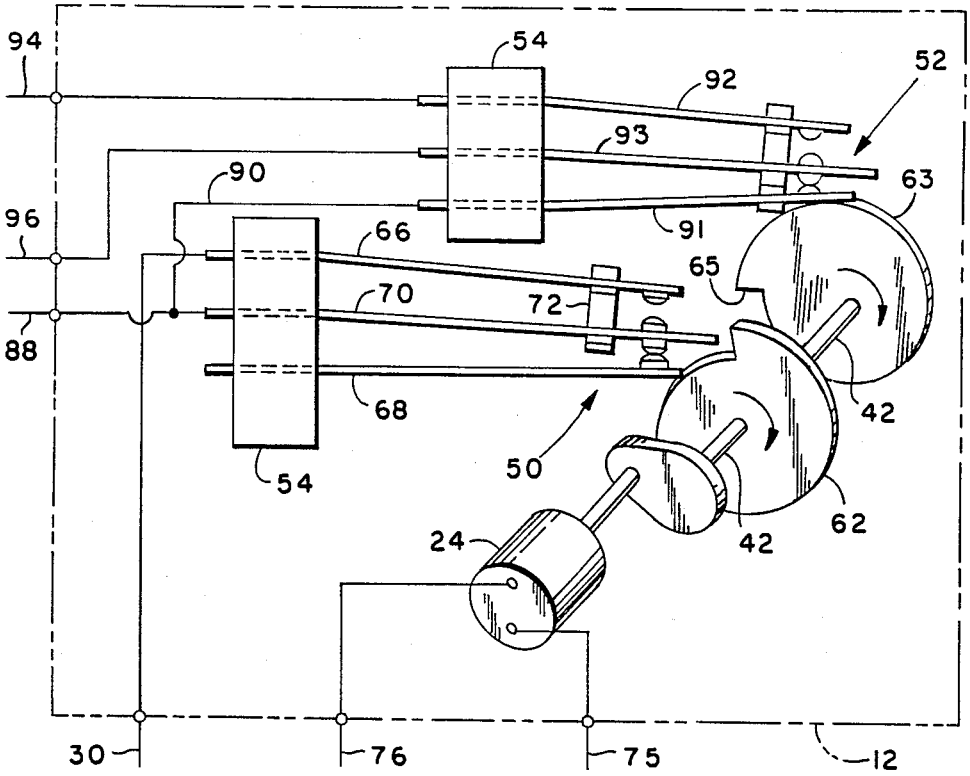
FIG. 5 is an enlarged pictorial somewhat schematic of a portion of the circuitry of FIG. 4.

Referring to FIGS. 4 and 5, lead 36 from side $L_2$ of the power line is connected through connector 28 to junction 74 within the controller 22, and is connected through lead 76 to one side of the motor 24, with the remaining side of the motor connected to one terminal 76 of a single pole double throw shut off switch indicated generally at 78. It will be understood that the shut off switch 78 may be operated by the cam drum 46 in a manner well known in the art and may also have a mechanical interrupt in the form of an ice bin level sensor (not shown) in a manner also well known in the art and for which the details have been omitted for the sake of brevity. Shut off switch 78 has its opposite terminal 77 connected via junction 80 to the lead 35 and through junction 34 to the side $L_1$ of the power line.

Junction 74 is also connected to one lead of resistance heater 26, with the remaining side thereof connected to junction 82 which is connected to one side of a thermostatic switch, indicated generally at 84, which has the opposite terminal thereof connected via lead 86 to the common terminal of switch 78. Junction 82 is also connected via lead 88 to the intermediate or center contact blade 70 of the water valve switch 50 which has the lower contact blade 66 thereof connected, through connector 28 and via lead 30, to water valve coil 15. The remaining terminal of the coil 15 is connected via lead 32 and junction 34 to the power line $L_1$.

The center contact blade 70 of the valve switch 50 is also connected via lead 90 to the terminal 91 of the hold switch 52. The terminal 92 of the hold switch 52 is connected via lead 94 junction 80 and lead 35 to junction 34 on the side $L_1$ of the power line.

The common terminal blade 93 of the hold switch 52 is connected via lead 96 to the contact 76 of the shut off switch 78.

Figure 6:
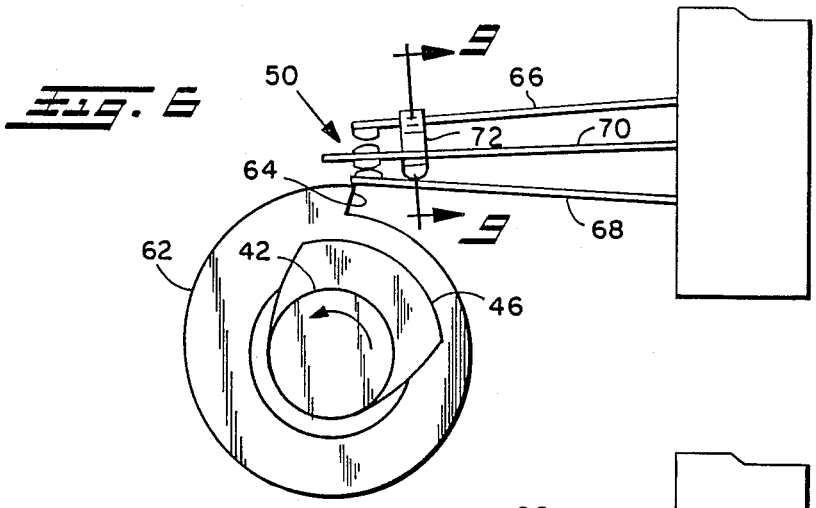
FIG. 6 is a view of a portion of FIG. 5 and shows the switch in the open position during freezing of the water in the mold.
Figure 7:
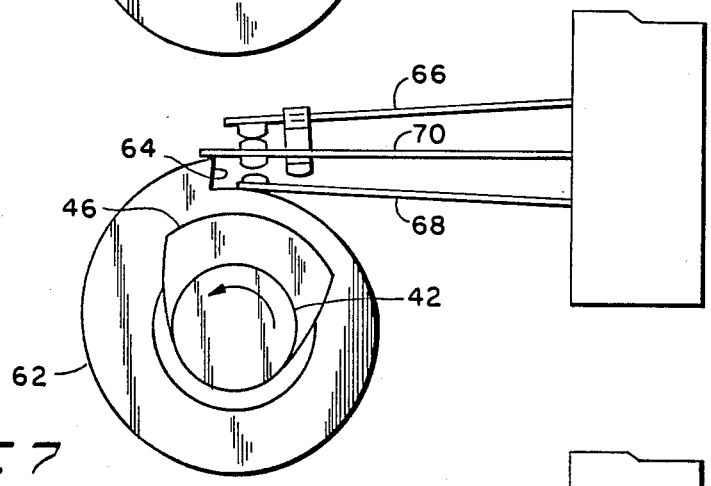
FIG. 7 is a view similar to FIG. 6 and shows the valve switch in the closed position during water fill.
Figure 8:
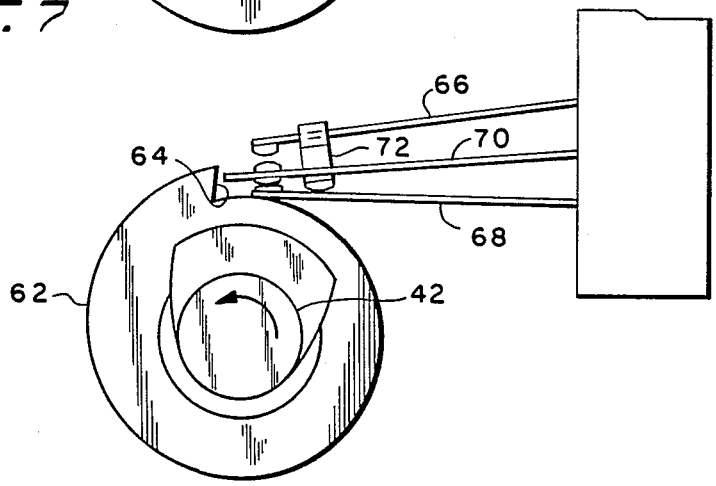
FIG. 8 is a view similiar to FIG. 6 and shows the cam rotated to a position opening the valve switch upon completion of water fill; and, FIG. 9 is an enlarged section view taken along section indicating lines 9—9 of FIG. 6.

Referring to FIGS. 6, 7 and 8, the cam track 62 is disposed for following by the ends of the contact blades of switch 50. With reference to FIG. 6, the cam track 62 is positioned such that the highest profile level of the cam track 62, adjacent the radial step 64, has raised the lower switch contact blade 68 to cause closure of the contacts between the lower blade 68 and the intermediate blade 70. In the position shown in FIG. 6 the lower leg of the C-shaped spacer 72 rests against the upper surface of lower blade 68. The spacer 72 thus has raised the upper contact blade 66 to move the upper set of contacts between blade 66 and blade 70 to the open position. With the cam track 62 in a position shown in FIG. 6, the circuit to the water valve coil 15 is open and no current flows to the coil.

Referring to FIG. 7, the cam track 62 has been located rotated through a central angle of approximately 20° from the position shown in FIG. 1 such that the end of the lower contact 68 has dropped over radial step 64 to the lower level of the cam track 62; and, the end of the intermediate blade 70 now rests on the upper level of the radial step 64. In the position shown in FIG. 7, the movement of the lower contact blade 68 has permitted the spacer to fall and permit the upper contact blade 66 to contact the intermediate blade 70, thereby making a circuit therebetween for energizing the coil 15 of the water valve.

Referring to FIG. 8, the cam track 62 has been rotated counterclockwise a small additional amount from the position shown in FIG. 7 such that the end of the intermediate contact blade 70 has dropped over the radial step 64 to the lower level of cam track 62. In the position shown in FIG. 8, the lower arm of the spacer 72 rests against the upper surface of the lower contact blade 68 thereby maintaining the predetermined distance between the contact blade 68 and the upper blade 66 and the intermediate blade 70 is permitted to rest against the lower contact blade 68 which in turn opens the upper set of contacts between upper contact blade 68 and the intermediate contact blade 70 thereby again breaking the circuit to the valve coil 15. The arrangement of the cam track 62 in FIGS. 6, 7 and 8 thus provides a convenient way of making and breaking of the upper set of contacts between contact blade 66 and intermediate contact blade 70 for rapid energization and deenergization of the water valve coil with only a small fraction of a full revolution of the cam track 62.

It will be understood that a similar cam track arrangement as that of track 62 is also provided identified by reference numeral 63 in FIG. 3 for the hold switch 52. The track 63 is formed with a radial step 65 similar to step 64, but the track 63 has the radial step disposed at a different circumferential position from that of the radial step 64 for cam track 62. The position of the radial step 65 for cam track 63 is arranged to sequence the closing of the upper set of contacts between switch blades 92 and 93 of hold switch 52 for maintaining current to the motor 24 when the thermostatic switch 84 is open. The arrangement of the radial step 65 on cam track 63 thus provides a rapid making and breaking of the contacts between contact blades 93 and 91 and 93 and 92 of switch 52 in the same manner as described with reference to FIGS. 6, 7, & 8 for switch 50.

In operation, closure of the thermostat switch 84 energizes the motor through the upper contacts between blades 92 and 93 of switch 52 which are in the closed position and the motor rotates the cam 63 to close the lower contact set between contact blades 93 and 91 maintaining current to the motor until the contact blade 91 drops over the radial step 65 to open contact blades 91 and 93 shut off the motor. The motor remains in the off position until such time as the thermostat recloses to begin another cycle. If the thermostat is closed, the motor continues to receive power through switch contact blade 91 and lead 88 from junction 82.

The present invention thus provides proper opening and closing of cam actuated switch contacts for controlling the harvest cycle and drive motor and the waterfill valve in an icemaker. The rapid making and breaking of the switch contact blades is provided by a preferably undercut radial step on the cam tracks for actuating the switches. A spacer is attached to one of the switch contact blades for maintaining the side contacts at a minimum spacing to thereby provide rapid drop action of the lower side contact blade and the intermediate blade for effecting rapid opening and closing thereof while the spacer maintains the upper contact blade fixed with respect to the lower contact blade to simultaneously provide making and breaking of the upper contact blade set. Although the invention has hereinabove been described with respect to the illustrated embodiments, it will be understood that the invention is capable of modification and variation and is limited only by the following claims.

We claim

1. An automatic icemaker for a refrigerator comprising:

(a) a rotatable cam having a step therein, said cam adapted for motorized timed advancement;

(b) switch means having (i) an upper and lower resiliently movable contact blade, (ii) an intermediate resiliently movable contact blade disposed between said upper and lower blade; said blades biased toward said cam;

(c) spacer means attached to one of said upper and lower contact blades, said spacer means operative to maintain a minimum spacing between said upper and lower contact means;

(d) said lower and intermediate contact blades disposed to drop on said step respectively in sequence for rapidly closing and opening a set of normally open contacts between said intermediate and upper contacts and for opening and closing a pair of normally closed contacts between said lower and intermediate contacts;

(e) motor means including speed reducing means operable to effect advancement of said cam at a timed rate;

(f) electrically operated valve means series connected with said normally open contact set for timed actuation with respect to said cam advancement;

(g) a second rotatable cam having a second step; and, (h) second switch means disposed for operation by said second step and series connected to said motor means for maintaining current to said motor means.

2. An icemaker for a refrigerator comprising:

(a) an electrically operated fill valve adapted for connection to a water line and operative upon electrical energization to provide controlled flow to an ice mold;

(b) a rotable cam means having a first and second cam track, each track having a step thereon;

(c) motor means, including speed reducing means, operable to advance said first and second cam track at a timed rate;

(d) valve switch means having, (i) upper and lower resiliently movable contact blades disposed in spaced arrangement;

(ii) an intermediate resiliently movable contact blade disposed between said upper and lower contact blades, (iii) spacer means attached to one of said upper and lower contact blades, and operative to maintain a predetermined spacing therebetween; said lower and intermediate contact blades operative to drop on said first cam track step respectively in sequence for closing and opening said normally open positions of said upper and intermediate contact blades for timed energization of said fill valve; and (e) hold switch means having, (i) upper and lower resiliently movable contact blades disposed in spaced management, (ii) an intermediate resiliently movable contact blade disposed between said upper and lower contact blades (iii) spacer means attached to one of said upper and lower contact blades and operative to maintain a predetermined minimum spacing therebetween; said lower and intermediate blades operative to drop on said second cam track step in sequence respectively for closing and opening said upper and intermediate contact blades for maintaining current to said motor means.

* * * * *